US005991967A

United States Patent [19]

Williams

[11] Patent Number: 5,991,967

[45] Date of Patent: Nov. 30, 1999

[54] CLEANING DEVICE FOR SHOE SOLES

[76] Inventor: Bennie E. Williams, 3306 George Light Rd., Knoxville, Tenn. 37931

[21] Appl. No.: 09/107,773

[22] Filed: Jun. 30, 1998

[51] Int. Cl.[6] ..... A47L 23/22; A47L 7/02

[52] U.S. Cl. ..... 15/311; 15/37; 15/36

[58] Field of Search ..... 15/30, 33, 36, 15/37, 161, 215, 216, 217, 237, 238, 301, 303, 310, 311

[56] References Cited

U.S. PATENT DOCUMENTS

| | | | |
|---|---|---|---|
| 345,291 | 7/1886 | Fein . | |
| 632,533 | 8/1899 | Mock et al. . | |
| 1,470,894 | 10/1923 | Throop . | |
| 1,619,814 | 3/1927 | Fisher | 15/311 |
| 1,711,116 | 4/1929 | Keenan . | |
| 1,805,203 | 5/1931 | Brasty . | |
| 1,830,455 | 11/1931 | Zrnel . | |
| 2,704,852 | 3/1955 | Stone . | |
| 2,860,366 | 11/1958 | Kemp | 15/311 |
| 2,895,159 | 7/1959 | Ostrow | 15/311 |
| 3,064,298 | 11/1962 | Jones | 15/310 |
| 3,065,478 | 11/1962 | Lawrin . | |
| 3,115,653 | 12/1963 | Fresh et al. | 15/311 |
| 3,641,609 | 2/1972 | Hansen . | |
| 3,649,994 | 3/1972 | Harris | 15/311 |
| 5,588,175 | 12/1996 | Zahner | 15/310 |

*Primary Examiner*—Terrence R. Till
*Attorney, Agent, or Firm*—Pitts & Brittian, P.C.

[57] ABSTRACT

The present invention provides a cleaning device for shoe soles. The cleaning device includes a housing in which a brush rack assembly and an oscillating device for oscillating the brush rack assembly are housed. The brush rack assembly includes a plurality of brush rods situated in a spaced manner. Each of the brush rods defines a rod from which a multitude of bristles extend. The cleaning device also includes a vacuum assembly for catching and removing dirt removed from the shoe soles. Specifically, the vacuum assembly includes a vacuum device and a reservoir. The brush rack assembly is supported in the reservoir and the reservoir defines a port which extends through the housing and to which the vacuum device is connectable.

18 Claims, 2 Drawing Sheets

CLEANING DEVICE FOR SHOE SOLES

TECHNICAL FIELD

This invention relates to the field of cleaning devices for removing debris from shoe soles.

BACKGROUND ART

It is widely known in the art of shoe cleaning to utilize mats with bristles for removal of dirt and other debris from the soles of shoes. Typical of the art are those devices disclosed in the following U.S. Pat. Nos.:

| U.S. Pat. No. | Inventor(s) | Issue Date |
|---|---|---|
| 345,291 | S. M. Fein | July 13, 1886 |
| 632,533 | Mock et al. | Sept. 5, 1899 |
| 1,711,116 | G. A. Keenan | April 30, 1929 |
| 1,830,455 | J. Zrnel | Nov. 3, 1931 |
| 2,704,852 | W. V. Stone | March 29, 1955 |
| 3,065,478 | A. Lawrin | Nov. 27, 1962 |
| 3,641,609 | W. M. Hansen | Feb. 15, 1972 |

Typically, the bristles are secured to a mat and removal of any dirt or debris from the shoes soles is effected by the wearer brushing the shoe soles against the bristles. Several devices include a frame which supports the bristles above a reservoir for catching the dirt and debris removed from the shoe soles. Often the bristles will become clogged with dirt and become ineffective. Further, the reservoir can fill up with dirt and clog the bristles as well.

Therefore, it is an object of this invention to provide cleaning device for shoe soles which includes bristles which are powered to remove dirt and debris from shoe soles.

It is another object of the present invention to provide a cleaning device for shoe soles wherein the bristles oscillate back and forth.

Further, it is an object of the present invention to provide a cleaning device for shoe soles which includes a vacuum device for pulling dirt and debris from the shoes soles and dirt and debris loosened by the bristles.

DISCLOSURE OF THE INVENTION

Other objects and advantages will be accomplished by the present invention which provides a cleaning device for shoe soles. The cleaning device includes a housing in which a brush rack assembly and an oscillating device for oscillating the brush rack assembly are housed. The brush rack assembly includes a plurality of brush rods situated in a spaced manner. Each of the brush rods defines a rod from which a multitude of bristles extend. The cleaning device also includes a vacuum assembly for catching and removing dirt removed from the shoe soles. Specifically, the vacuum assembly includes a vacuum device and a reservoir. The brush rack assembly is supported in the reservoir and the reservoir defines a port which extends through the housing and to which the vacuum device is connectable.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A cleaning device for shoe soles incorporating various features of the present invention is illustrated generally at 10 in the figures. The cleaning device for shoe soles 10 is designed to remove dirt and debris from shoe soles via oscillating bristles. Moreover, in the preferred embodiment the cleaning device for shoe soles 10 includes a vacuum assembly for pulling dirt away from the shoe soles and dirt collected on the bristles.

Figure 1:
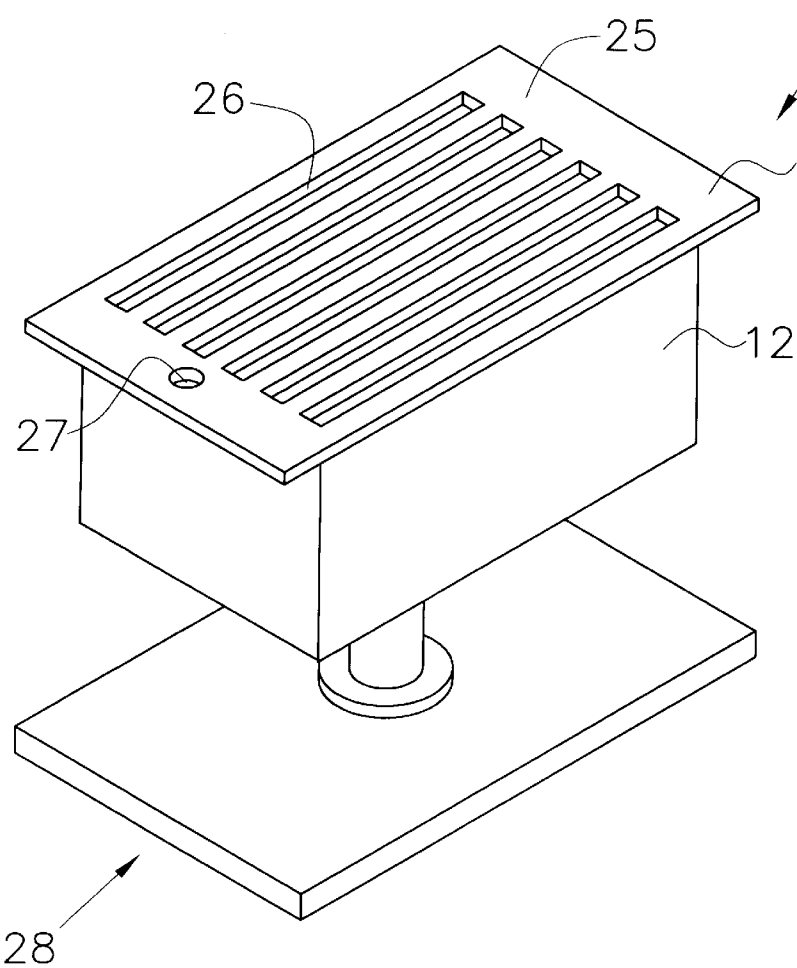
FIG. 1 is a perspective view of the cleaning device for shoe soles constructed in Accordance with several features of the present invention.
Figure 2:
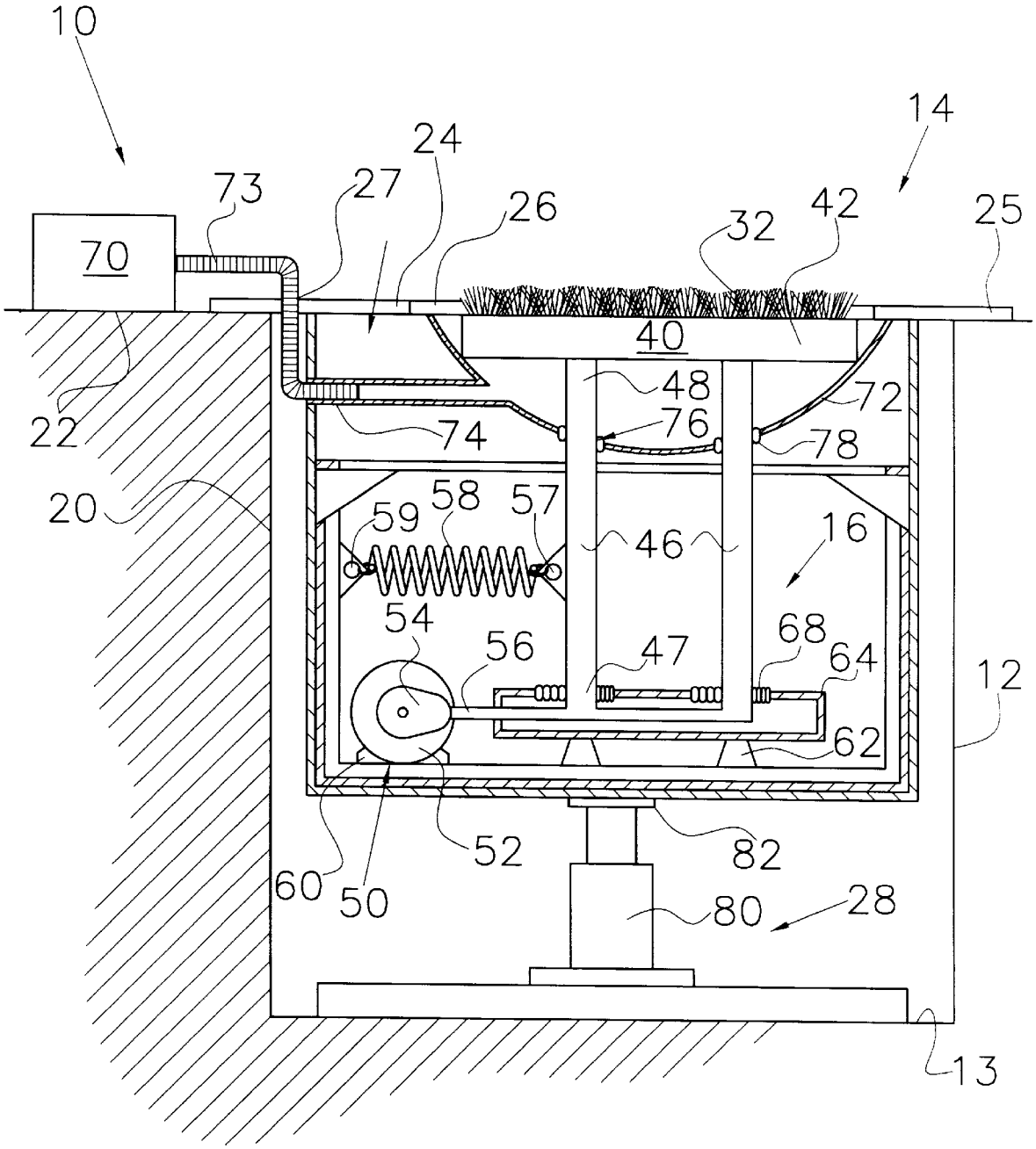
FIG. 2 is a side view of the cleaning device of FIG. 1.

The cleaning device 10 is generally comprised of a housing 12 in which a brush rack assembly 14, an oscillating device 16 for oscillating the brush rack assembly 14 and a vacuum assembly 18 are housed, as shown in FIG. 2. The housing 12 is received in a recess 20 in a surface 22 such as a floor. Preferably, the cleaning device 10 further includes a grate 24, a perimeter 25 of which rests on the surface 22. The grate is configured to cover the recess 20, defines a plurality of slotted openings 26 through which a portion of the brush rack assembly 14 extends and defines a vacuum hose opening 27 through which a flexible vacuum hose 73 is receivable. The grate 24 is shown most clearly in FIG. 1. Also, in the preferred embodiment, the cleaning device 10 includes a lifting device 28 for raising and lowering the housing 12, and thus the brush rack assembly 14.

Figure 3:
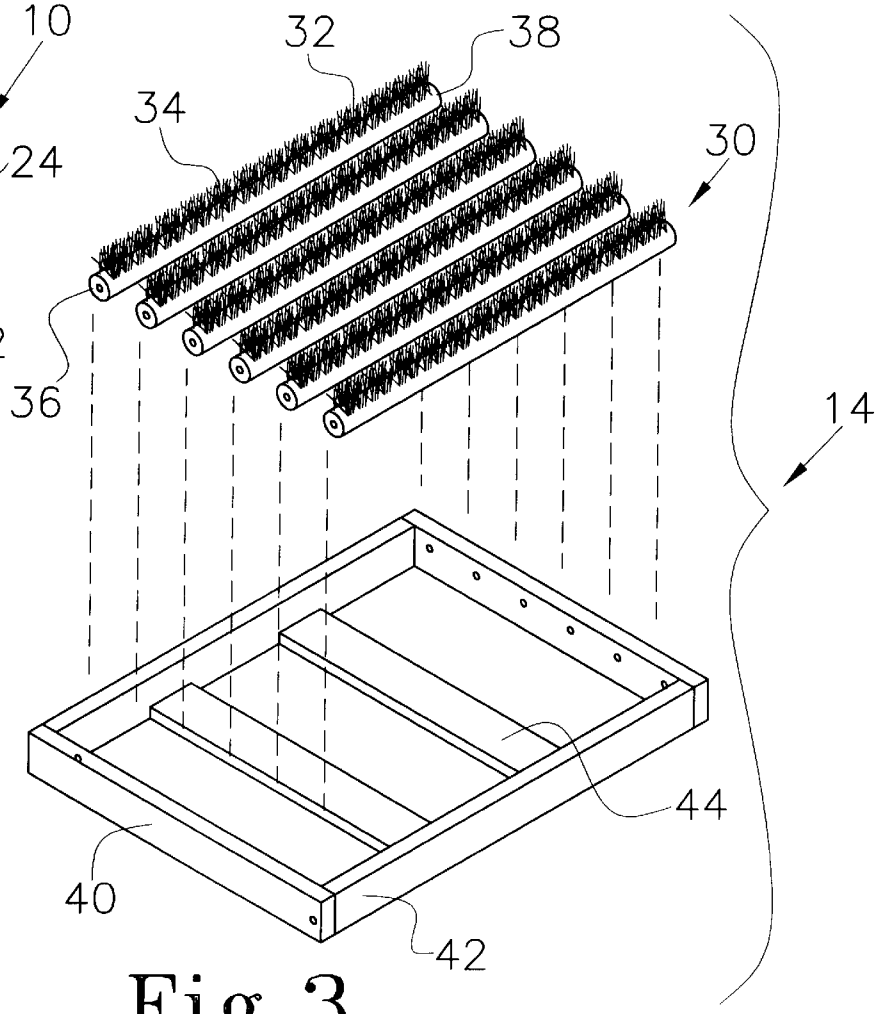
FIG. 3 illustrates an exploded view of the brush rack assembly.

The brush rack assembly 14 includes a plurality of brush rods 30 secured to a frame 40 in a spaced manner, as shown in FIG. 3. The frame 40 is generally comprised of four side walls 42 and at least one support beam 44 extending between opposing side walls 42. Each of the brush rods 30 includes a multitude of bristles 32 extending from a top portion of a rod 34. A first end 36 of each rod 34 is securely mounted to one side wall 42 and a second end 38 of each rod 34 is secured to an opposing side wall 42. In the preferred embodiment, the frame 40 is rectangular in configuration and includes two support beams 44 spaced apart and positioned perpendicular to the brush rods 30, as shown in FIG. 3. The bristles 32 of each brush rod 30 are extendable through the slotted openings 26 of the grate 24. In the preferred embodiment, the frame 40, rods 34 and grate 24 are manufactured from steel and the bristles 32 are manufactured from nylon and are imbedded in the rod 34. Preferably, the frame 40 is fabricated such that it can be dismantled for replacement of the brush rods 30.

The oscillating device 16 serves to oscillate the frame 40, and thus the brush rods 30, in a horizontal manner. In the preferred embodiment, the oscillating device 16 includes a cam assembly 50 and at least one pylon 46. A first end 47 of the pylon 46 is secured to the cam assembly 50 and a second end 48 of the pylon 46 is secured to the support beam 44 of the frame 40. In the preferred embodiment, the oscillating device 16 includes two pylons 46, one pylon 46 being mounted to each of the support beams 44 of the frame 40. The cam assembly 50 oscillates the frame 40 via the pylons 46.

In the preferred embodiment, the cam assembly 50 includes a motor 52, a cam 54 and a cam follower 56. The motor 52 rotates the cam 54, and the cam 54 imparts oscillating motion to the cam follower 56. The two pylons 46 extend from the cam follower 56. It will be noted that the cam follower 56 must maintain constant contact with the edge of the cam 54. In the embodiment depicted, the cam 54 is egg shaped and constant contact between the cam 54 and the cam follower 56 is effected via a biasing spring 58. Specifically, a first end 59 of the spring 58 is mounted to the housing 12 and the second end 57 of the spring 58 is secured to one of the pylons 46. The spring 58 and the cam 54 cooperate to impart oscillating motion to the frame 40 via the pylons 46. It will be noted that the cam assembly 50 can define any configuration which serves to impart an oscillating motion to the frame. For example, the cam can be circular and rotated off center. Further, constant contact can be achieved with a cam that defines a groove in its edge in which the first end of the cam follower rides or the cam assembly can include two cams, one positioned on either end of the cam follower and each configured to effect an oscillating motion. In the preferred embodiment, motor vibration dampeners 60 are positioned proximate the motor 52 to absorb vibrations associated with the motor 52.

In the preferred embodiment, the cleaning device 10 includes a oscillating device vibration dampener 62 positioned proximate the cam follower 56. Specifically, the cam follower 56 is encased in a sleeve 64, as shown in FIG. 2, and the oscillating device vibration dampener 62 rests of the floor 13 of the housing 12 and supports the sleeve 64. The sleeve 64 defines sleeve openings 66 through which the pylons 46 extend. The sleeve 64 is stationary, therefore the sleeve openings 66 must define a size that accommodates the oscillating motion of the pylons 46. Preferably, a seal 68 is positioned around each pylon 46 at its intersection with the sleeve 64, as shown in FIG. 2.

The vacuum assembly 18 includes a reservoir 72 and a vacuum device 70. The reservoir 72 is positioned below the brush rack assembly 14 and is configured to collect dirt and debris removed from shoe soles via the brush rods 30. The reservoir 72 defines a port 74 which extends through the housing 12 and to which the vacuum device 70 is connectable. In the embodiment illustrated in FIG. 2, the vacuum device 70 is connected to the port 74 via a flexible hose 73. It will be noted that the port 74 can be connected to a central vacuum system. The vacuum device 70 removes the dirt and debris collected in the reservoir 72. The reservoir 72 defines openings 76 for receiving the pylons 46 therethrough. In the preferred embodiment, a seal 78 is positioned around each pylon 46 where it intersects with the reservoir 72, as shown in FIG. 2. The reservoir 72 oscillates with the brush rack assembly 14.

It will be noted that in an alternate embodiment, the brush rack assembly 14 includes a sanitary spray mister which would apply a sanitary spray to the bristles and the vacuum provides sufficient air flow to completely dry the shoe soles before leaving the cleaning device.

The lifting device 28 raises and lowers the housing 12 such that the bristles 32 of the brush rods 30 extend through the slotted openings 26 of the grate 24 when the housing 12 is lifted and withdraw from the slotted openings 26 when the housing 12 is lowered. In the preferred embodiment, the lifting device 28 includes a hydraulic cylinder 80 and a housing support 82. The housing support 82 is mounted to the underside of the housing 12 and the hydraulic cylinder 80 lifts the housing 12 via the housing support 82.

The operation of the cleaning device 10 is described hereinafter. When a person steps onto the grate 24, the oscillating device 16, the lifting device 28 and the vacuum device 70 are activated via a pressure sensor, a motion sensor or a manual switch. The lifting device 28 lifts the housing 12 such that the bristles 32 of the brush rods 30 extend through the slotted openings 26 of the grate 24. In the preferred embodiment, the bristles 32 extend approximately ¾ of an inch from the top of the grate 24. The motor 52 of the oscillating device 16 rotates the cam 54 which imparts oscillating motion to the cam follower 56 and thus the brush rack assembly 14. A timer controls the amount of time the oscillating device 16 and vacuum device 70 operate. After the time expires, the oscillating and vacuum devices 16, 70 are deactivated and the lifting device 28 lowers the housing 12 such that the bristles 32 withdraw from the slotted openings 26 of the grate 24. It will be noted that in the preferred embodiment, when stepping of the cleaning device 10, the shoes are positioned perpendicular to the brush rods 30 such that a maximum surface of the shoe soles are contacted by the bristles 32 of the brush rods 30.

In the preferred embodiment, the cleaning device 10 includes an emergency shut off switch for turning off the entire unit and the lifting device 28 includes an override switch. When the override switch is activated the hydraulic cylinder 80 will extend to its maximum length and lock in place which allows for easy access to the brush rods 30 and vacuum reservoir 72 for cleaning or repair.

From the foregoing description, it will be recognized by those skilled in the art that a cleaning device for shoe soles offering advantages over the prior art has been provided. Specifically, the cleaning device for shoe soles provides oscillating brush rods to remove dirt and debris from shoe soles. Further, the cleaning device includes a vacuum device for removing the dirt and debris loosened from the shoe soles.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A cleaning device for shoe soles being received in a recess of a surface, said cleaning device for shoe soles comprising:

a housing receivable in the recess;

a brush rack assembly including a plurality of brush rods situated in a spaced manner, each of said plurality of brush rods defining a rod from which a multitude of bristles extend;

an oscillating device for oscillating said brush rack assembly;

a vacuum assembly including a vacuum device and a reservoir, said brush rack assembly being supported in said reservoir, said reservoir being supported in said housing, said reservoir defining a port which extends through said housing and to which said vacuum device is connectable.

2. The cleaning device for shoe soles of claim 1 further including a grate defining a perimeter and a plurality of slotted openings, said perimeter resting on the surface of the recess, said grate covering the recess and positioned above said brush rack assembly, each of said plurality of slotted openings being aligned with one of said plurality of brush rods, said multitude of bristles of each of said plurality of brush rods being extendable through said plurality of slotted openings.

3. The cleaning device for shoe soles of claim 2 wherein said grate defines a vacuum hose opening for receiving a vacuum hose therethrough, said vacuum device being supported on the surface, said vacuum device being connected to said port via said vacuum hose.

4. The cleaning device for shoe soles of claim 1 further including a lifting device for lifting and lowering said housing.

5. The cleaning device for shoe soles of claim 4 wherein said lifting device includes a hydraulic cylinder and a housing support, said housing support being mounted to a bottom of said housing, said hydraulic cylinder lifting said housing via said housing support.

6. The cleaning device for shoe soles of claim 1 wherein said brush rack assembly further defines a frame including four side walls and at least one support beam, each of said rods defining a first end and a second end, said first end being secured to one of said side walls and said second end being secured to an opposing said side wall, said at least one support beam extending between two opposing said side walls, said oscillating assembly being secured to said at least one support beam.

7. The cleaning device for shoe soles of claim 1 wherein said oscillating device includes a cam assembly and at least one pylon, a first end of said at least one pylon being secured to said cam assembly, a second end of said pylon being secured to said brush rack assembly, said cam assembly imparting oscillating motion to said brush rack assembly via said at least one pylon.

8. The cleaning device for shoe soles of claim 7 wherein said cam assembly includes a motor, a cam, a cam follower, and a biasing spring, said motor rotating said cam, said cam imparting motion to said cam follower, said cam being configured such that said cam follower oscillates, said first end of said pylon being secured to said cam follower, a first end of said biasing spring being mounted to an interior wall of said housing, a second end of said biasing spring being mounted to said pylon, said biasing spring for maintaining constant contact between said cam and said cam follower.

9. A cleaning device for shoe soles being received in a recess of a surface, said cleaning device for shoe soles comprising:

a housing receivable in the recess;

a brush rack assembly including a plurality of brush rods situated in a spaced manner, each of said plurality of brush rods defining a rod from which a multitude of bristles extend;

an oscillating device for oscillating said brush rack assembly;

a vacuum assembly including a vacuum device and a reservoir, said brush rack assembly being supported in said reservoir, said reservoir being supported in said housing, said reservoir defining a port which extends through said housing and to which said vacuum device is connectable;

a grate defining a perimeter and a plurality of slotted openings, said perimeter resting on the surface of the recess, said grate covering the recess and positioned above said brush rack assembly, each of said plurality of slotted openings being alignable with one of said plurality of brush rods, said multitude of bristles of each of said plurality of brush rods being extendable through said plurality of slotted openings; and, a lifting device for lifting said housing such that said multitude of bristles of each of said plurality of brush rods are extended through each of said slotted openings of said grate, said lifting device for lowering said housing such that said multitude of bristles withdraw from each of said slotted openings.

10. The cleaning device for shoe soles of claim 9 wherein said lifting device includes a hydraulic cylinder and a housing support, said housing support being mounted to a bottom of said housing, said hydraulic cylinder lifting said housing via said housing support.

11. The cleaning device for shoe soles of claim 9 wherein said brush rack assembly further defines a frame including four side walls and at least one support beam, each of said rods defining a first end and a second end, said first end being secured to one of said side walls and said second end being secured to an opposing said side wall, said at least one support beam extending between two opposing said side walls, said oscillating assembly being secured to said at least one support beam.

12. The cleaning device for shoe soles of claim 9 wherein said oscillating device includes a cam assembly and at least one pylon, a first end of said at least one pylon being secured to said cam assembly, a second end of said pylon being secured to said brush rack assembly, said cam assembly imparting oscillating motion to said brush rack assembly via said at least one pylon.

13. The cleaning device for shoe soles of claim 9 wherein said cam assembly includes a motor, a cam, a cam follower, and a biasing spring, said motor rotating said cam, said cam imparting motion to said cam follower, said cam being configured such that said cam follower oscillates, said first end of said at least one pylon being secured to said cam follower, a first end of said biasing spring being mounted to an interior wall of said housing, a second end of said biasing spring being mounted to said at least one pylon, said biasing spring for maintaining constant contact between said cam and said cam follower.

14. The cleaning device for shoe soles of claim 9 wherein said grate defines a vacuum hose opening for receiving a vacuum hose therethrough, said vacuum device being supported on the surface, said vacuum device being connected to said port via said vacuum hose.

15. A cleaning device for shoe soles being received in a recess of a surface, said cleaning device for shoe soles comprising:

a housing receivable in the recess;

a brush rack assembly including a plurality of brush rods secured to a frame in a spaced manner, each of said plurality of brush rods defining a rod from which a multitude of bristles extend, each of said rods defining a first end and a second end, said frame including four side walls and at least one support beam, said first end of said rod being secured to one of said side walls, said second end of said rod being secured to an opposing said side wall, said at least one support beam being secured to opposing said side walls;

an oscillating device for oscillating said brush rack assembly, said oscillating device including a cam assembly and at least one pylon, a first end of said at least one pylon being secured to said cam assembly, a second end of said pylon being secured to said at least one support beam, said cam assembly imparting oscillating motion to said brush rack assembly via said at least one pylon;

a vacuum assembly including a vacuum device and a reservoir, said brush rack assembly being supported in said reservoir, said at least one pylon extending through and supporting said reservoir, said reservoir defining a port which extends through said housing and to which said vacuum device is connectable;

a grate defining a perimeter and a plurality of slotted openings, said perimeter resting on the surface of the recess, said grate covering the recess and positioned above said brush rack assembly, each of said plurality of slotted openings being alignable with one of said plurality of brush rods, said multitude of bristles of each of said plurality of brush rods being extendable through said plurality of slotted openings; and, a lifting device for lifting said housing such that said multitude of bristles of each of said plurality of brush rods are extended through each of said slotted openings of said grate, said lifting device for lowering said housing such that said multitude of bristles withdraw from each of said slotted openings.

16. The cleaning device for shoe soles of claim 15 wherein said lifting device includes a hydraulic cylinder and a housing support, said housing support being mounted to a bottom of said housing, said hydraulic cylinder lifting said housing via said housing support.

17. The cleaning device for shoe soles of claim 15 wherein said cam assembly includes a motor, a cam, a cam follower, and a biasing spring, said motor rotating said cam, said cam imparting motion to said cam follower, said cam being configured such that said cam follower oscillates, said first end of said at least one pylon being secured to said cam follower, a first end of said biasing spring being mounted to an interior wall of said housing, a second end of said biasing spring being mounted to said at least one pylon, said biasing spring for maintaining constant contact between said cam and said cam follower.

18. The cleaning device for shoe soles of claim 15 wherein said grate defines a vacuum hose opening for receiving a vacuum hose therethrough, said vacuum device being supported on the surface, said vacuum device being connected to said port via said vacuum hose.

* * * * *